US012018509B2

(12) United States Patent
Liu et al.

(10) Patent No.: US 12,018,509 B2
(45) Date of Patent: Jun. 25, 2024

(54) POOL-CLEANING ROBOT

(71) Applicant: WARM ENVIRONMENTAL EQUIPMENT QIDONG CO., LTD, Nantong (CN)

(72) Inventors: Wei Liu, Nantong (CN); Qijie Tian, Nantong (CN); Jiamo Zhang, Nantong (CN)

(73) Assignee: WARM ENVIRONMENTAL EQUIPMENT QIDONG CO., LTD, Nantong (CN)

( * ) Notice: Subject to any disclaimer, the term of this patent is extended or adjusted under 35 U.S.C. 154(b) by 0 days.

(21) Appl. No.: 18/082,599

(22) Filed: Dec. 16, 2022

(65) Prior Publication Data

US 2024/0141667 A1 May 2, 2024

(30) Foreign Application Priority Data

Oct. 26, 2022 (CN) ..... 202211319029.7

(51) Int. Cl.

| | |
|---|---|
| ***E04H 4/16*** | (2006.01) |
| ***A47L 5/12*** | (2006.01) |
| ***A47L 9/28*** | (2006.01) |

(52) U.S. Cl.

CPC ..... *E04H 4/1654* (2013.01); *A47L 5/12* (2013.01); *A47L 9/2842* (2013.01); *A47L 9/2847* (2013.01); *A47L 9/2852* (2013.01); *A47L 9/2884* (2013.01); *A47L 2201/04* (2013.01); *A47L 2201/06* (2013.01); *E04H 4/1636* (2013.01)

(58) Field of Classification Search

CPC ..... E04H 4/16; E04H 4/1636; E04H 4/1654

See application file for complete search history.

(56) References Cited

U.S. PATENT DOCUMENTS

| | | | |
|---|---|---|---|
| 2015/0337556 A1 | 11/2015 | Shlomi-Shlomi et al. | |
| 2021/0079679 A1* | 3/2021 | Hui | E04H 4/1654 |
| 2021/0254359 A1* | 8/2021 | Sebor | E04H 4/1672 |
| 2022/0066456 A1 | 3/2022 | Ebrahimi Afrouzi et al. | |

FOREIGN PATENT DOCUMENTS

| | | |
|---|---|---|
| CN | 103358839 A | 10/2013 |
| CN | 112814435 A | 5/2021 |
| CN | 213418613 A | 6/2021 |

* cited by examiner

*Primary Examiner* — Michael D Jennings
(74) *Attorney, Agent, or Firm* — IPRTOP LLC

(57) ABSTRACT

A pool-cleaning robot is provided, comprising: a robot body with a moving mechanism controlled to move the robot body forward or backward; wherein the robot body has a weight difference between its left and right sides; the moving mechanism includes a driver to drive the moving mechanism unilaterally; the robot body is provided with a fluid inlet-outlet, at least one first fluid inlet, and at least one first fluid outlet, which are communicated with each other. The fluid inlet-outlet is provided with a fluid driver that applies a suction force to the first fluid inlet or a discharge force to the first fluid outlet; a controller in the robot body, connected to and controlling the operation of the moving mechanism and the fluid driver; when the robot body is on a floor or walls of a pool, combinations of discharge forces, suction forces and weight differences steer the robot.

15 Claims, 7 Drawing Sheets

POOL-CLEANING ROBOT

CROSS REFERENCE TO RELATED APPLICATION

The present application claims the benefit of priority to Chinese Patent Application No. CN 2022113190297, entitled "POOL-CLEANING ROBOT", filed with CNIPA on Oct. 26, 2022, the disclosure of which is incorporated herein by reference in its entirety for all purposes.

FIELD OF TECHNOLOGY

The present disclosure generally relates to robotics and, in particular, to pool-cleaning robots.

BACKGROUND

Traditional pool cleaning methods rely on manual operations, which are not only inefficient and expensive, but also wasteful of water resources.

To address this issue, pool-cleaning robots that automate pool cleaning are now available on the market. Pool-cleaning robots usually have a pair of front and rear cleaning rollers driven by a motor as their moving mechanism. The cleaning rollers can drive debris backward, after which a pair of suction ports between the pair of cleaning rollers will draw in water carrying the debris into an internal filter chamber to filter out the debris before discharging filtered water.

In the related technology, a method to steer a pool-cleaning robot is achieved by differential speeds of two sides of the robot, but this method requires multiple motors and multiple corresponding cleaning rollers to cooperate with the motors, making the solution costly.

SUMMARY

The present disclosure provides a pool-cleaning robot, comprising: a robot body, provided with a moving mechanism configured to controllably move the robot body forward or backward; wherein there is a weight difference between left and right sides of the robot body; wherein the moving mechanism comprises a driver, which is connected to a heavier side of the left and right sides of the robot body, and drives the moving mechanism; wherein the robot body is provided with a fluid inlet-outlet and at least one first fluid inlet communicated with the fluid inlet-outlet through a first fluid channel, and at least one first fluid outlet communicated with the fluid inlet-outlet through a second fluid channel; the first fluid channel and the second fluid channel are communicated; wherein the at least one first fluid inlet and the at least one first fluid outlet are located at a bottom of the robot body and are away from an axis of the robot body; wherein the first fluid channel is provided with at least one filter chamber communicated with the at least one first fluid inlet; wherein the fluid inlet-outlet is provided with a fluid driver configured to controllably apply a suction force to the at least one first fluid inlet or a discharge force to the at least one first fluid outlet; and a controller, provided in the robot body, connected to and controlling the operation of the moving mechanism and the fluid driver; wherein, when the robot body operates on a floor of a pool, a combination of the discharge force and the weight difference steers the pool-cleaning robot; when the robot body operates on walls of the pool, a combination of the suction force and the weight difference steers the robot body.

In one embodiment, at least one counterweight is removably provided in at least one of the left and right sides of the robot body.

In one embodiment, the heavier side of the left and right sides of the robot body has an uneven mass distribution along a front-to-back direction of the robot body.

In one embodiment, the robot body comprises a battery supplying power to the pool-cleaning robot, and a charging port for connecting the battery.

In one embodiment, the controller is configured to select one of cleaning modes based on an input command and then to control the pool-cleaning robot to work on the floor or the walls of the pool in accordance with the cleaning modes.

In one embodiment, the cleaning modes comprise one or more of: a floor mode, in which the pool-cleaning robot operates only on the floor of the pool; a wall mode, in which the pool-cleaning robot reaches a wall of the pool, and operates thereon for a predetermined duration; a mix mode, in which the pool-cleaning robot operates on both the floor and the walls of the pool; and a waterline mode, in which the pool-cleaning robot reaches a waterline of the pool and operates along the waterline for a predetermined duration.

In one embodiment, the robot body further comprises a gyroscope; wherein the controller is electrically connected to the gyroscope and configured to identify whether the robot body is located on the floor or a wall of the pool based on output signals of the gyroscope, and limits the moving mechanism within a movement range according to a determined cleaning mode.

In one embodiment, the robot body further comprises a communication interface connected to the controller; wherein the communication interface is in a wired or wireless communication with an external control device; wherein the external control device displays a human-computer interaction interface for receiving operations to form the input command to the controller.

In one embodiment, the human-computer interaction interface is a physical panel or a graphical user interface (GUI); wherein the human-computer interaction interface displays a plurality of control keys for controlling the pool-cleaning robot, and the plurality of control keys comprises operation keys for at least one of the cleaning modes.

In one embodiment, the human-computer interaction interface comprises a plurality of indicators for respectively indicating states of the pool-cleaning robot; wherein the plurality of indicators comprises at least one indicator corresponding to at least one of the cleaning modes; wherein when one of the plurality of indicators and one of the plurality of control keys correspond to the same clean mode, they are integrated together or separated disposed on the human-computer interaction interface; wherein each indicator has one or more light-emitting states, which individually or in combination indicate operating states or fault states of the pool-cleaning robot.

In one embodiment, the at least one first fluid inlet is so configured that when the pool-cleaning robot moves vertically upward along a wall of the pool to the waterline, the at least one first fluid inlet exposes the pool-cleaning robot to air to draw in air to create buoyancy; wherein the buoyancy temporarily suspends the pool-cleaning robot, after which the pool-cleaning robot reorientates due to the weight difference, and then moves in a lateral direction.

In one embodiment, the weight difference is so configured that it causes the pool-cleaning robot to temporarily maintain a steering angle of less than 90 degrees when moving along the waterline.

In one embodiment, the pool robot is a wired robot with a cable attached during operation; wherein the weight difference has a steering torque on the pool-cleaning robot greater than a steering torque provided by the cable on the pool-cleaning robot.

In one embodiment, the pool-cleaning robot, when moving laterally, is configured to climb from a current wall where it is located to a target wall, utilizing a frictional force generated when the moving mechanism is in contact with the target wall, the suction force, and a driving force, and to continue moving laterally on the target wall.

In one embodiment, the moving mechanism comprises: driving wheels, which are connected to the driver and rotate when driven by the driver; and a pair of cleaning rollers respectively disposed at a front portion and a rear portion of the pool-cleaning robot, wherein at least one of the pair of cleaning rollers is connected to the driving wheels in a drivable manner.

DETAILED DESCRIPTION

Figure 1:
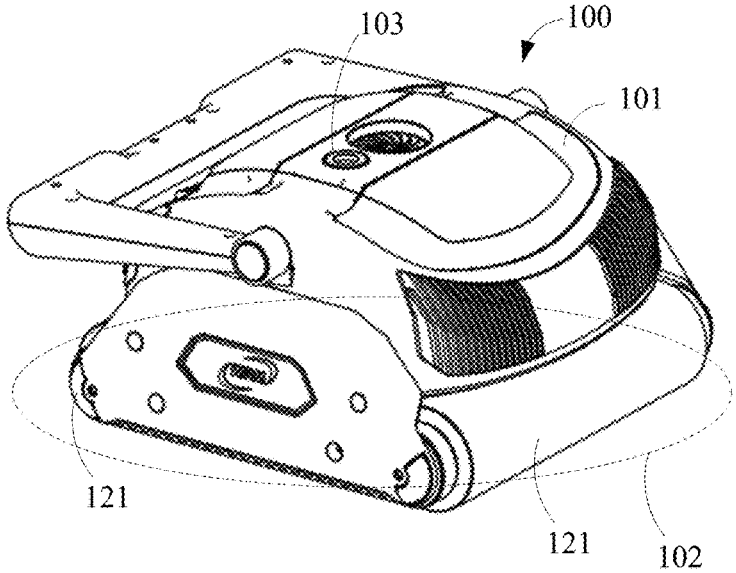
FIG. 1 shows a schematic side view of a pool-cleaning robot in one embodiment of the present disclosure.

The following describes the implementation of the present disclosure through specific examples, and those skilled in the art can easily understand other advantages and effects of the present disclosure from the content disclosed in this specification. The present disclosure can also be implemented or applied through other different specific embodiments. Various details in this specification can also be modified or changed based on different viewpoints and applications without departing from the spirit of the present disclosure. It should be noted that the following embodiments and the features in the embodiments can be combined with each other if no conflict will result.

The following detailed description is provided for embodiments of the present disclosure with reference to the accompanying drawings so that they can be easily implemented by a person skilled in the art to which the present disclosure belongs. The present disclosure may be embodied in many different forms and is not limited to the embodiments illustrated herein.

In the present disclosure, terms like "an embodiment," "one embodiment," "an example," "specific example", or "some examples" mean that the specific features, structures, materials, or characteristics represented in conjunction with the embodiment or example are included in at least one embodiment or example of the present disclosure. Further, the specific features, structures, materials, or characteristics represented may be combined in a suitable manner in any embodiments or examples. It should be noted that the following embodiments and examples, and features thereof be combined with each other by a person skilled in the art if no conflict will result.

In addition, the terms like "first" and "second" are used for indication purpose only, and are not to be construed as indicating or implying relative importance or implicitly specifying numbers of technical features indicated. Thus, features qualified with terms like "first" and "second" may explicitly or implicitly include at least one such feature. In the present disclosure, "a group" and "a pair" and means two or more, unless otherwise expressly specified.

For clarity of the present disclosure, elements not highly relevant to the invention may be omitted, and the same reference symbols are given to the same or similar elements throughout the specification.

Throughout the specification, when a first element is "connected" to a second element, the first element may be in a "direct connection" with the second element, or the first element may be in an "indirect connection" with the second element with another element between the two. Moreover, the terms "comprise", "include" or any other variations thereof are intended to encompass non-exclusive inclusion, such that a process, method, item, or device that comprises a series of elements can comprise not only those elements, but also other elements not explicitly listed, or elements inherent to such a process, method, item, or device.

Although in some examples the terms "first" and "second", etc. are used herein to denote various elements, these elements are limited by these terms. These terms are used only to distinguish one element from another. For example, first interface and second interface are two interfaces that are not necessarily ordered. As used herein, the singular forms "a", "an" and "said/the" are intended to include the plural forms, unless the context clearly points out differently. As used herein, the terms "or" and "and/or" are inclusive, and are used to include any of the associated listed items and all combinations thereof. Thus, "A, B or C" or "A, B and/or C" means "any of the following: A; B; C; A and B; A and C; B and C; A, B and C". Exceptions to this definition apply only when combinations of elements, functions, steps, or operations are inherently paradoxical in some way.

The terminology herein is used in an exemplary manner, and is not intended to limit the present disclosure. The singular forms are intended to include the plural forms, unless the context clearly points out differently.

Although not defined differently, all terms, including technical terms and scientific terms used herein, have the same meaning as generally understood by those skilled in the art to which this disclosure belongs.

The emergence of pool-cleaning robots has solved many of the problems associated with cleaning pools through manual means, including, for example, high labor costs and low efficiency. However, as the demand continues to rise, some of the problems associated with pool-cleaning robots have also emerged. For example, current pool-cleaning robots have a costly steering mechanism. Specifically, for example, Chinese Patent Application No. CN201821009475.7 provides a swimming pool underwater cleaning robot, which can realize the steering of the robot by driving corresponding track wheel sets through same-speed rotation and differential-speed rotation of two independent speed-reduction motors. In this way, more than two independent motors are required to drive the two track wheel sets, which is not only costly in terms of hardware, but also requires differential control corresponding to the two independent motors, which introduces cost due to control program development.

In view of this, the present disclosure provides a pool-cleaning robot, whose physical structure is so configured that suction and discharge effects generated during normal operations of the robot is utilized, and as a result, the robot is able to move and steer on different surfaces (such as the floor and walls) of a pool.

FIG. 1 shows an outline structure of a pool-cleaning robot 100 in one embodiment of the present disclosure.

The pool-cleaning robot 100 includes a robot body 101, the robot body 101 is provided with a moving mechanism 102 configured to controllably move the robot body 100 forward or backward; a pair of cleaning rollers 121 are exemplarily shown in FIG. 1, and the cleaning rollers 121 are disposed at the front and rear portions of the robot body 101, respectively. The pair of cleaning rollers 121 can perform forward or backward rolling to cause movement of the robot body 101, and the rolling of the cleaning rollers 121 is used to roll debris backward (with respect to the robot body 101). The pool-cleaning robot 100 employs a suction-and-filter cleaning method that draws in water carrying debris and then discharges filtered water.

In some embodiments, the moving mechanism 102 includes a driver, the driver may be a first motor providing a driving force. The moving mechanism 102 includes driving wheels which are connected to the driver and rotate when driven by the driver. The driving wheels are connected to at least one of the cleaning rollers 121 in a drivable manner. Further, the drivable manner may be one of sprocket driving or gear driving. By way of example, the sprocket driving can be as follows: tracks are wound between the driving wheels and a pair of driven wheels that are fixedly axially connected to the cleaning rollers 121, and friction exists between the surfaces of the cleaning rollers 121 and the tracks, or the cleaning rollers 121 and the tracks are engaged together; after the driving wheels are driven to rotate by the driver, they drive the tracks to rotate, and the tracks drive the rolling of the two cleaning rollers 121. Optionally, a plurality of tensioning wheels in contact with the tracks may also be provided to keep the tracks taut. Alternatively, in another embodiment, when the drivable manner is gear driving, refer to Chinese Patent Application No. CN202010967650.9, whose driving gears can be adopted as the driving wheels of the present disclosure, and the driving wheels are driven by the first motor for rotation. As described in CN202010967650.9, a driving gear engages with a drive inner gear opening distributed on a side of an active wheel, and a first motor controls the rotation of the driving gear, which in turn drives the active wheel to rotate through the drive inner gear opening, driving the one cleaning roller 121 pivoted thereto to rotate and the other cleaning roller 121 rotates as a result. The specific structure of the moving mechanism 102 is not limited herein.

The driver is connected to a heavier side of two sides of the robot, and drives the moving mechanism 102; that is, the present disclosure adopts unilateral driving. Unilateral drive facilitates steering of the robot body 101 when it is on the floor of the pool.

Exemplarily, the pool-cleaning robot 100 may be provided with a waterproof electrical port 103 for plugging in a cable connector.

Figure 2:
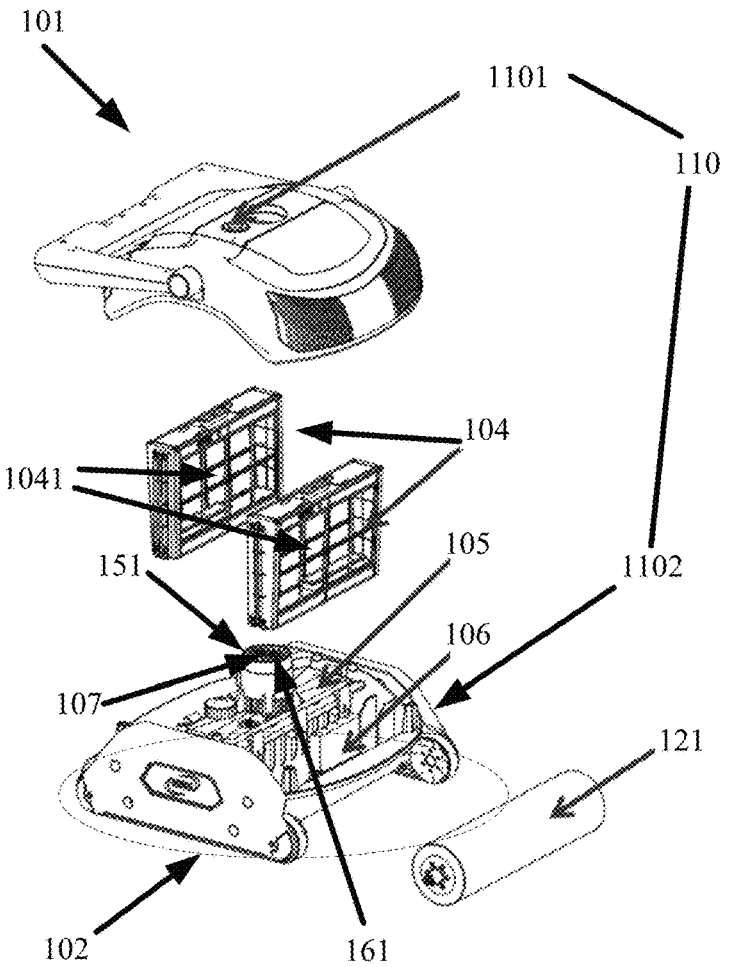
FIG. 2 shows an exploded view of a pool-cleaning robot in an embodiment of the present disclosure.

FIG. 2 shows an internal structure of a pool-cleaning robot 100 in one embodiment of the present disclosure.

The internal structure of the robot body 101 of the pool-cleaning robot 100 is shown in FIG. 2; the pool-cleaning robot 100 may work in a wireless manner and be powered by a battery. Specifically, the robot body 101 includes a housing 110, a moving mechanism 102, filter boxes 104, a mounting box 105, a battery box 106, etc. The housing 110 includes a top cover 1101 and a base 1102, and a space is formed between the top cover 1101 and the base 1102 for accommodating the mounting box 105. A pair of filter boxes 104 are provided on front and rear sides of the mounting box 105, and a mounting chamber is formed in the mounting box 105, and filter chambers 1041 are formed in the pair of filter boxes 104, and the two filter chambers 1041 and the mounting chamber may be communicated with each other. In FIG. 2, the cleaning roller 121 in the front portion of the moving mechanism 102 is removed from the moving mechanism 102. Optionally, its removal may be done by poking a fine object into a hole provided in a shaft section of the cleaning roller 121 to disengage the cleaning roller 121 from the robot body 101.

The mounting chamber is provided with a fluid inlet-outlet 151, and a fluid driver 161 capable of pumping or discharging fluid may be provided at the fluid inlet-outlet 151. Specifically, the fluid driver 161 may include an impeller 107 and a second motor connected to the impeller 107. The impeller 107 can be set at the fluid inlet-outlet 151 and the first motor can drive the impeller 107 to rotate in either direction to draw in or discharge fluid. The mounting box 105 may be formed with a space for accommodating motors, such as the first motor and the second motor.

Figure 3:
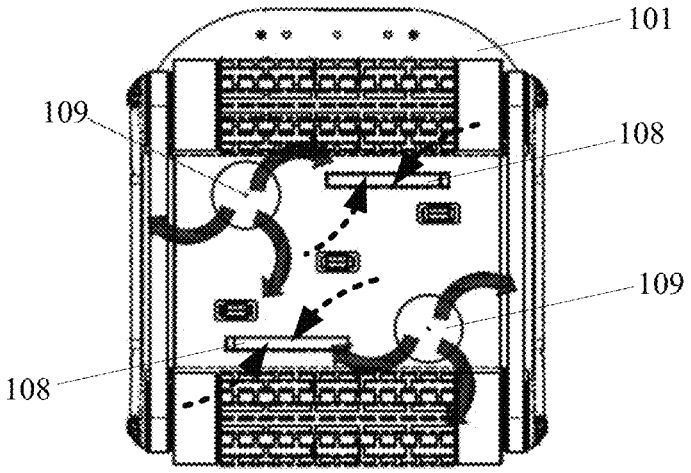
FIG. 3 shows a bottom view of a pool-cleaning robot in one embodiment of the present disclosure.

FIG. 3 shows a bottom view of a pool-cleaning robot in one embodiment of the present disclosure. Referring to FIG. 2 and FIG. 3, the robot body 101 is provided with at least one first fluid inlet 108, and at least one first fluid outlet 109. FIG. 3 exemplarily shows two first fluid inlets 108 and two first fluid outlets 109. Exemplarily, the first fluid inlets 108 and the first fluid outlets 109 may be provided at a bottom of the robot body. Each first fluid inlet 108 is correspondingly connected to a filter chamber 1041 within a filter box and is connected to the fluid inlet-outlet 151 as shown in FIG. 2 through a mounting chamber connected to the filter chamber 1041 to form a first fluid channel. When the impeller 107 in FIG. 2 rotates in a first direction (e.g., counterclockwise, or clockwise), a suction force is generated in each of the first fluid inlets 108, as indicated by the dash arrows in FIG. 3. The suction force can suck water into the filter chambers 1041; filtered water flows through the mounting chamber, and it is then propelled by the impeller and finally discharged at the fluid inlet-outlet, to realize the cleaning of the pool. Moreover, the suction force as well as counter thrust produced by discharged water allows the pool-cleaning robot 100 to move on the wall of the pool without falling off.

In addition, each first fluid outlet 109 and the fluid inlet-outlet 151 as shown in FIG. 2, as well as the space between the two and outside the corresponding filter boxes, form a second fluid channel. When the impeller rotates in a second direction opposite to the first direction (e.g., clockwise, or counterclockwise), it pushes water around the filter boxes and out of the first fluid outlets 109, as indicated by the solid arrows in FIG. 3. Thereby, an outwardly directed discharge force is generated at each first fluid outlet 109, and the discharge force may be used to propel the robot body away from the floor of the pool before performing a desired action, such as floor steering.

The robot body 101 has a weight difference between the left and right sides of the robot body 101, and the weight difference can be used in conjunction with the suction or discharge forces to achieve steering of the robot body 101 on various surfaces of the pool.

Figure 4:
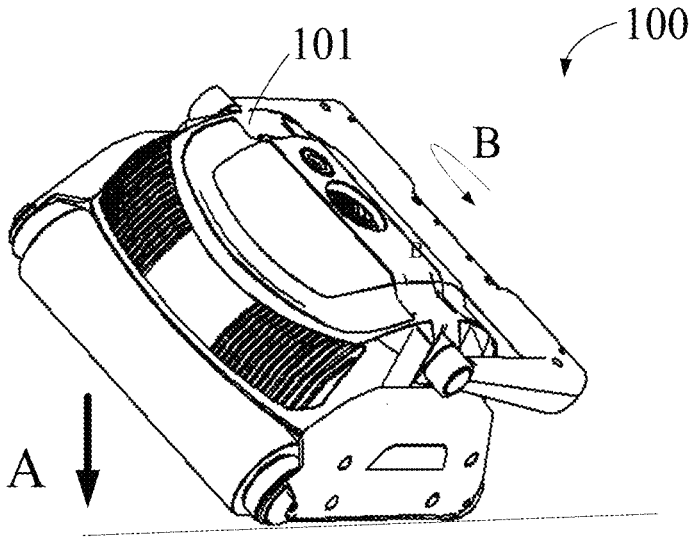
FIG. 4 shows a schematic diagram of a pool-cleaning robot steering on the floor of a pool in one embodiment of the present disclosure.

FIG. 4 shows a schematic diagram of a pool-cleaning robot 100 steering on the floor of a pool in one embodiment of the present disclosure.

As can be seen in the figure, when the two first fluid outlets discharge water, the robot body 101 is lifted, and because of the weight difference between the left and right sides of the robot body 101, the robot body 101 is tilted towards one side, as illustrated by the arrow A; the first motor is disposed in the heavier side, so that the first motor unilaterally drives a portion of the cleaning roller that is still in contact with the floor to roll, causing the robot body 101 to steer, as illustrated by the arrow B.

Optionally, as shown in FIG. 3, the first fluid outlets 109 are set on the bottom of the robot body 101 in positions away from an axis of the robot body 101. The axis is parallel to the forward or backward directions of the pool-cleaning robot 100. Further, in the case where there are two first fluid outlets 109 as shown in FIG. 3, the asymmetrical setting of the two first fluid outlets 109 is more helpful for steering.

Figure 5A:
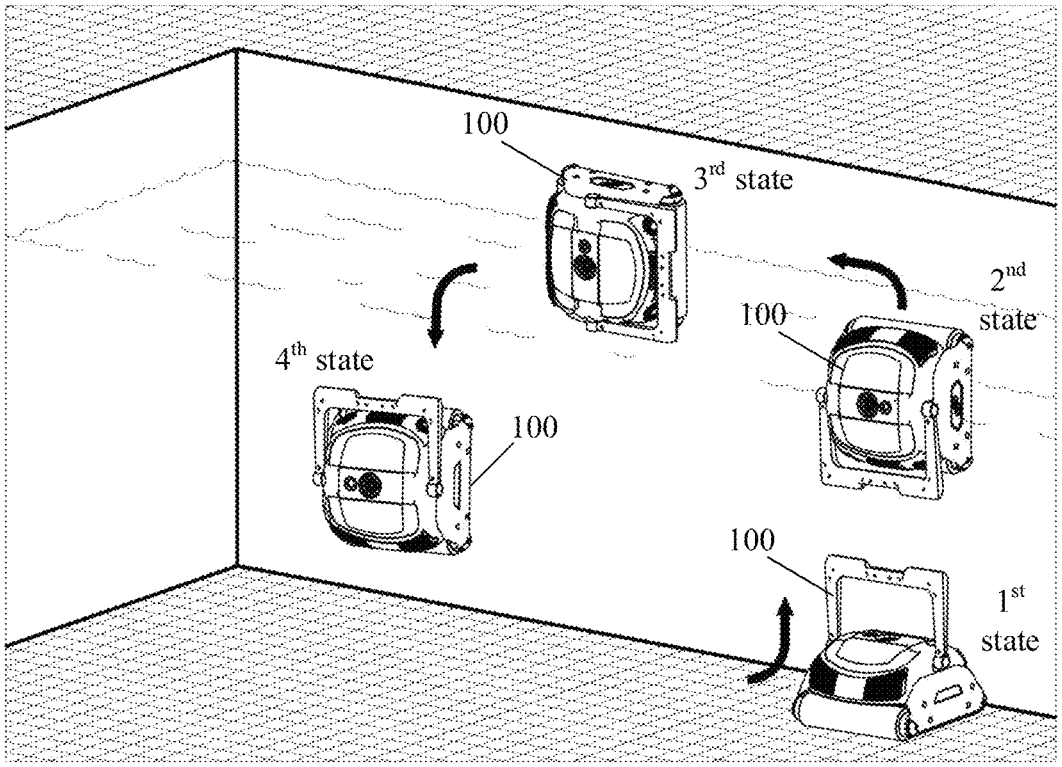
FIG. 5A is a schematic diagram showing an exemplary trajectory of a pool-cleaning robot steering on a wall of a pool in an embodiment of the present disclosure.

FIG. 5A is a schematic diagram showing an exemplary trajectory of a pool-cleaning robot 100 steering on a wall of a pool in an embodiment of the present disclosure.

As shown in FIG. 5A, in the first state, the pool-cleaning robot 100 prepares to climb a wall of the pool by moving on the floor toward the wall, and when the pool-cleaning robot 100 reaches a junction between the floor and the wall, the cleaning rollers of the pool-cleaning robot 100 and the wall get into contact, and then the frictional force between the cleaning rollers and the wall, the driving force that pushes the pool-cleaning robot 100 forward, and the suction force generated when cleaning enable the pool-cleaning robot 100 to climb the wall; the pool-cleaning robot 100 adheres to the wall under the action of the suction force and climbs upwards under the action of the driving force, as shown in the second state. When the pool-cleaning robot 100 reaches the waterline, it is unable to move further upward in one embodiment. Driven by driving force produced by the first motor, the pool-cleaning robot 100 will reorientate toward the heavier side due to the weight difference between its left and right sides; in an example, as shown in FIG. 5A, the left side is the heavier side, and the pool-cleaning robot 100 turns left and then continues to move. During this process, at least a portion of the at least one first fluid inlet may be exposed to air, drawing air into an internal chamber (e.g., the mounting chamber, filter chamber, etc.) to increase buoyancy so that the pool-cleaning robot 100 can perform cleaning along the waterline temporarily or permanently in state 3, as shown FIG. 5A. Further, after a period of operation, under the action of gravity and/or the intake of water while discharging air, the pool-cleaning robot 100 sinks and again reorientates towards the heavier side; as shown FIG. 5A, the pool-cleaning robot 100 turns downward in state 4. After that, it climbs downward under the combined effect of the suction force, gravity and driving force.

In some embodiments, the pool-cleaning robot 100 can move forward or backward, and the left side being heavier while moving forward is equivalent to the right side being heavier while moving backward. Thus, the pool-cleaning robot 100 can also achieve an upward steering (i.e., rightward steering from the robot's point of view) when moving laterally on the wall.

Although a trajectory of the pool-cleaning robot 100 with twice 90-degree steering at different positions on the wall is shown in FIG. 5A, it is not the only possible trajectory; different weight differences between the two sides, different driving and suction forces, and possible random changes in the forces will result in various possible trajectories of the pool-cleaning robot 100 during the steering process; all these various possible trajectories can be utilized, for example, to enhance the cleaning effect, and to diversify operations modes of the robot.

Figure 5B:
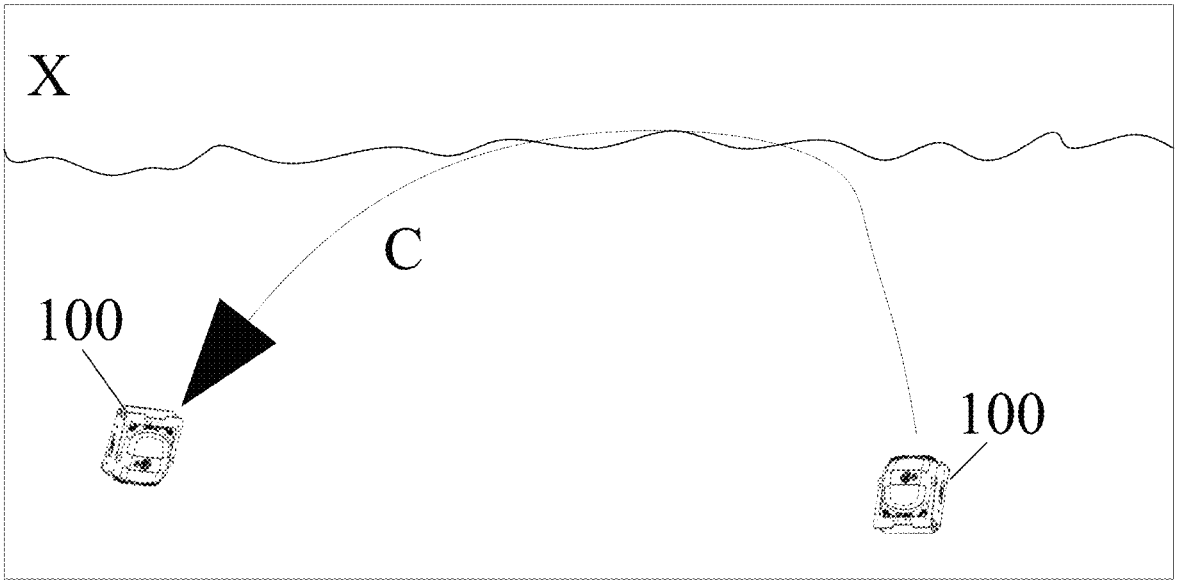
FIG. 5B shows a schematic diagram of a trajectory C of a pool-cleaning robot on a wall of a pool in an embodiment of the present disclosure.

In some embodiments, the pool-cleaning robot 100 may move along a curved trajectory. For example, the gravitational force of the pool-cleaning robot 100 is always greater than the buoyancy force asserted upon it, and thus the pool-cleaning robot 100 will gradually sink as it moves laterally on a wall, i.e., as shown in the trajectory C of the pool-cleaning robot 100 on the wall X in FIG. 5B; the pool-cleaning robot 100 may also have a slight deviation to the heavier side as it climbs upward.

Figure 5C:
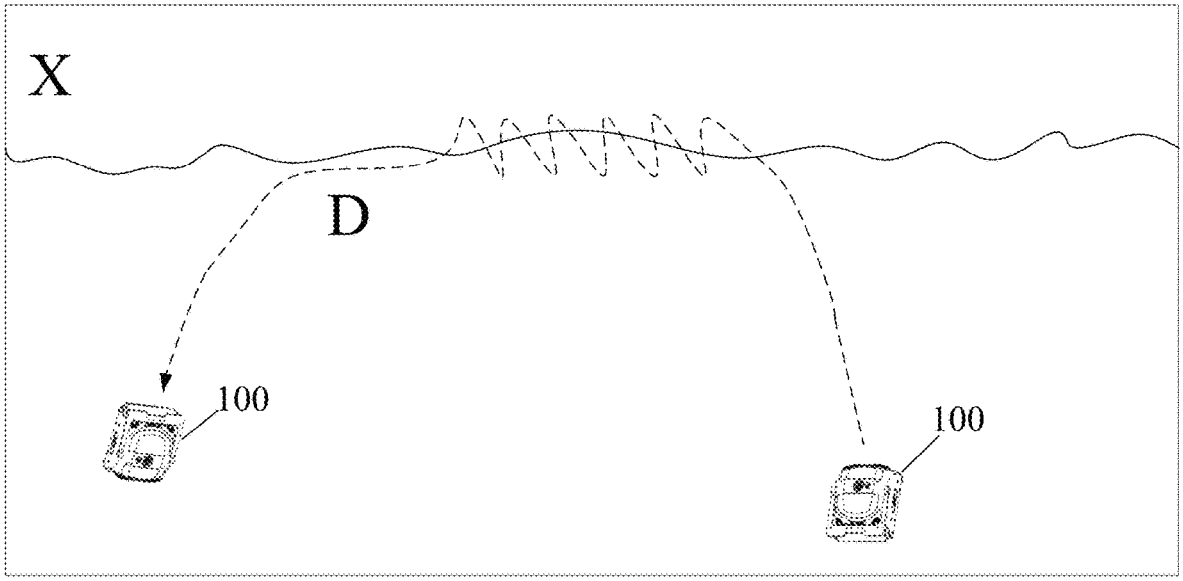
FIG. 5C shows a schematic diagram of a trajectory D of a pool-cleaning robot on a wall of a pool in an embodiment of the present disclosure.

In some embodiments, the pool-cleaning robot 100 may move upward with an initial angle with respect to a vertical direction (a direction substantially perpendicular to the floor, or the direction parallel to the direction of the gravitational force), and then at some point be propelled by the driving force to travel laterally before it completely reorientates to the heavier side (herein, a complete orientation will make the moving direction of the pool-cleaning robot 100 perpendicular to the vertical direction). Thus, while traveling laterally on the wall, the trajectory of the pool-cleaning robot may have up and down fluctuations. Specifically, reference may be made to the trajectory D shown in FIG. 5C, where the pool-cleaning robot 100 first climbs upward on the wall X, then steers to the left to travel laterally, with up and down fluctuations while traveling laterally, and later dives below the surface. The up and down fluctuations around the waterline greatly facilitate cleaning of the waterline.

Figure 5D:
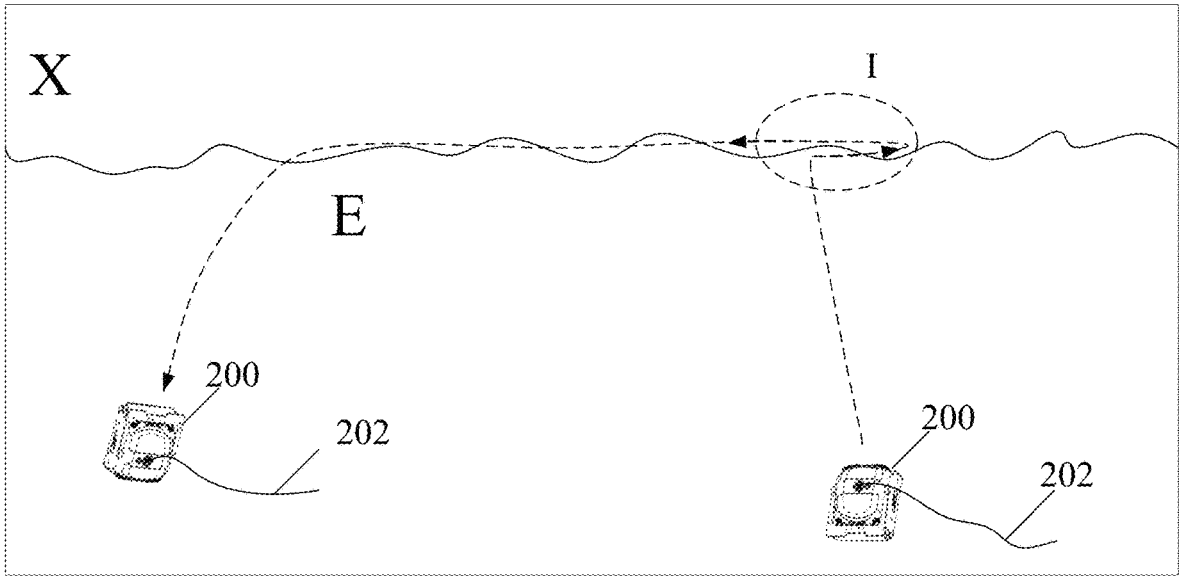
FIG. 5D shows a schematic diagram of a trajectory E of a pool-cleaning robot on a wall of a pool in an embodiment of the present disclosure.

In some embodiments, for wired pool-cleaning robots, they require a cable attached to them for power supply. Therefore, the cable is always connected during the operation of wired pool-cleaning robots. The cable itself has a gravitational force asserted upon it, and therefore there is a certain chance that the cable will hang to the lighter side as the pool-cleaning robot climbs up to the waterline, in which case initially the pool-cleaning robot may temporarily turn to the lighter side and then travel laterally, and later be dragged by the heavier side and reorientate accordingly before continuing to travel laterally, resulting in a trajectory having a U-turn. Specifically, referring to the trajectory E in FIG. 5D, the pool-cleaning robot 200 connected to the cable 202 climbs upward on the wall X, then turns to the lighter side (i.e., the right side as shown in FIG. 5D) to which the cable 202 hangs, then travels laterally for a distance, then reorientates to the left under the action of the heavier side, then moves laterally along the waterline to the left, and then finally dives under the surface. It can be seen from the trajectory E that the pool-cleaning robot 200 has the capability of making a U-turn while traveling laterally; that is, in the trajectory E, it travels laterally for a longer distance (i.e., having an expanded movement range) than the previous trajectories C and D along the waterline, as shown in the area I circled by dashes. Moreover, a round-trip cleaning of the area I is carried out, which improves the cleaning effect.

In related technology, lateral drainage is used to directly push the pool-cleaning robot to drift laterally, while the pool-cleaning robot still maintains the same upward posture that it had when it climbed upward. In this case, the direction of the drainage force and the moving direction of the pool-cleaning robot 100 is not the same (even perpendicular to each other), resulting in a need to for the pool-cleaning robot 100 to overcome frictional forces asserted upon it while drifting laterally in the upward posture (the frictional forces are tangential or nearly tangential to the moving direction, and therefore the latter is unable to mitigate the former), and thus the pool-cleaning robot can only maintain a low speed while drifting laterally and causes electricity waste. In contrast, the present disclosure ditches lateral drainage and related structures, and introduces reorientation before traveling laterally, which is much faster and saves electrical energy, and therefore helps to improve the battery life of wireless pool-cleaning robots.

In some embodiments, the magnitude of the weight difference between the two sides of the robot body 101 is adjustable. By way of example, at least one counterweight is removably provided on at least one of the two sides of the robot body 101. By configuring the number of counterweights, different steering needs of different scenarios can be satisfied, such as steering speed, steering stability, etc.

In some embodiments, the heavier side itself has an uneven mass distribution along a front-to-back direction of the robot body 101. For example, a front portion of the heavier side is heavier compared to a rear portion of the heavier side, which increases steering speed when moving forward.

The pool-cleaning robot 100 of the present disclosure can also climb from one wall to another.

Figure 6:
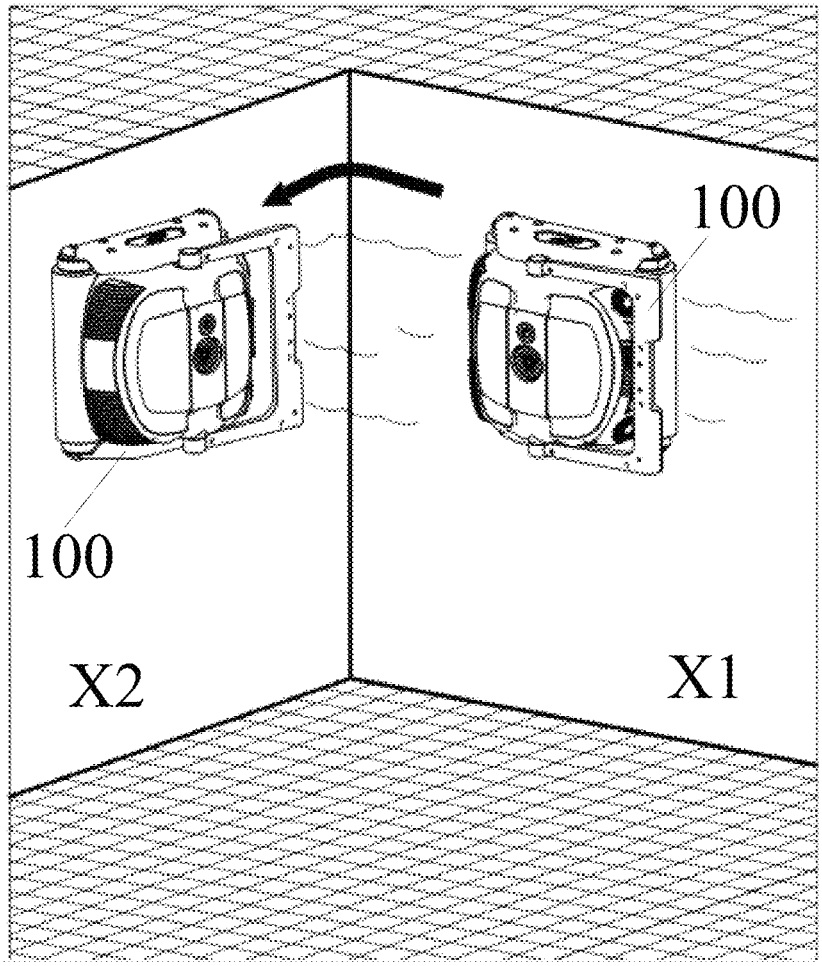
FIG. 6 shows a schematic diagram of a pool-cleaning robot climbing between two walls of a pool in an embodiment of the present disclosure.

FIG. 6 is a schematic diagram showing a pool-cleaning robot climbing from one wall to another according to an embodiment of the present disclosure.

In FIG. 6, the pool-cleaning robot 100 uses the suction force generated when performing the cleaning action to remain on a first wall X1, and, using the frictional force generated by the cleaning roller in the front touching a second wall X2, the pool-cleaning robot 100 can move laterally onto the second wall X2 while staying adhered to the first wall and/or the second wall, thereby finally climbing from the first wall to the second wall.

In the case of pushing the pool-cleaning robot to move laterally by lateral drainage in the related technology, at the junction between the first wall and the second wall, the pool-cleaning robot will be unable to make its cleaning roller(s) smoothly contact the second wall, and therefore cannot obtain the frictional force needed to climb onto the second wall. In contrast, the present disclosure can provide more diversified climbing actions of the pool-cleaning robot, enriching its applications and satisfying more in-depth user needs.

Figure 7:
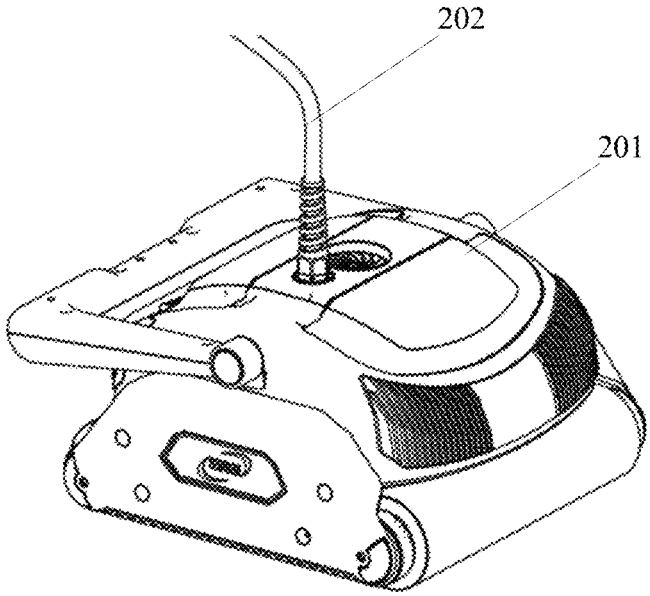
FIG. 7 shows a schematic structural diagram of a pool-cleaning robot with a waterproof electrical port connected to a cable in an embodiment of the present disclosure.

In some embodiments, the pool-cleaning robot 100 may be wireless. The pool-cleaning robot 100 may be provided with a battery inside, such as a lithium battery, and the waterproof electrical port of the pool-cleaning robot 100 in FIG. 1 may be a charging port for the battery. In another embodiment, which may be shown in FIG. 7, the pool-cleaning robot 100 may be wired, and the waterproof electrical port of the robot body 201 is connected to a power supply cable 202, and the power supply cable 202 may be connected to a power supply device outside the pool, such as a storage battery. Optionally, the power supply cable is buoyant and can float on the surface of the water to avoid tangling.

Figure 8:
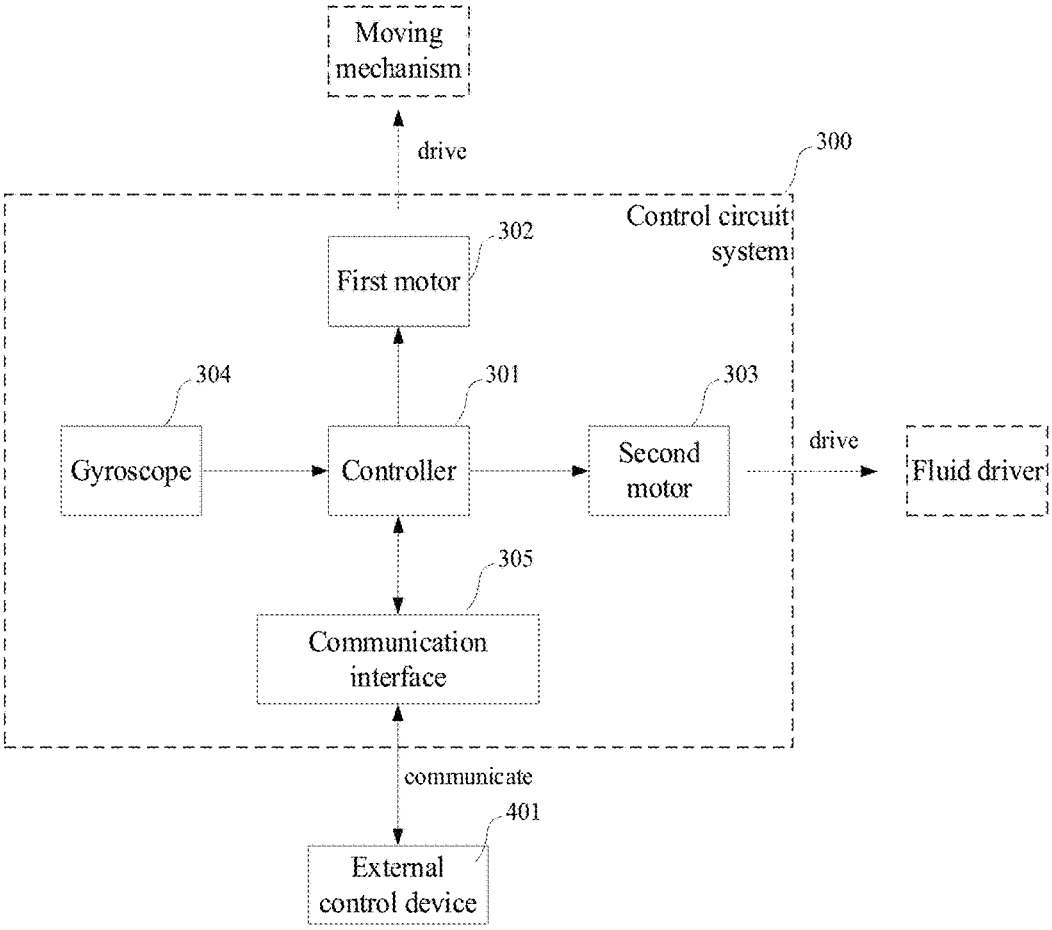
FIG. 8 shows a block diagram of a control circuit system of a pool-cleaning robot in an embodiment of the present disclosure.

The pool-cleaning robot 100 includes a control circuit system. A schematic diagram showing the control circuit system in an embodiment of the present disclosure is shown in FIG. 8.

The control circuit 300 system includes a controller 301, disposed in the robot body, connected to and controlling the operation of the moving mechanism and the fluid driver. For example, the controller 301 may be connected to and control the operation of a first motor 302 of the moving mechanism and a second motor 303 of the fluid driver.

In some embodiments, the pool-cleaning robot 100 may be pre-configured with different cleaning modes, and the cleaning modes includes at least one of the following: floor mode, wall mode, mix mode, and waterline mode. In the floor mode, the pool-cleaning robot operates on the floor of the pool. In the wall mode, the pool-cleaning robot reaches a wall of the pool, and operates thereon for a predetermined duration, the predetermined duration can be 2 hours or 5 hours, etc., and it leave the wall after working on the wall for the predetermined duration. In the mix mode, the pool-cleaning robot operates on both the floor and the walls of the pool. In the waterline mode, the pool-cleaning robot reaches a waterline of the pool and operates along the waterline for a predetermined duration, for example, the predetermined duration can be 2 hours or 5 hours, etc., and it leaves the waterline after working along the waterline for the predetermined duration. The controller 301 may be configured to select one of the cleaning modes based on an input command and then to control the pool-cleaning robot to work on the floor or the walls of the pool in accordance with the selected cleaning mode.

To be able to detect whether the pool-cleaning robot 100 is located on the floor or a wall, in some embodiments, the robot body 101 comprises a gyroscope 304. The gyroscope 304 may also be referred to as an angular velocity sensor, which detects changes in angular velocity, and is used for determining postures. In one embodiment, the gyroscope 304 may be used to determine the posture of the pool-cleaning robot 100. Specifically, the controller 301 is electrically connected to the gyroscope 304 and configured to detect whether the robot body 301 is located on the floor or a wall of the pool based on output signals of the gyroscope 304, and limits the moving mechanism within a movement range according to the selected cleaning mode. For example, in the wall mode, if the pool-cleaning robot 100 falls to the floor, the controller 301 will controls the pool-cleaning robot 100 to return to the wall that it was cleaning. Or, when the pool-cleaning robot 100 is approaching the floor, the controller 301 will prevent the pool-cleaning robot 100 from moving forward and reaching the floor.

In some embodiments, the robot body 101 includes a communication interface 305 connected to the controller 301; the communication interface 305 is in wired or wireless communication with an external control device 401.

In some embodiments, the external control device 401 displays a human-computer interaction interface for receiving operations to form input commands to the controller 301.

In some embodiments, the external control device 401 may be a control box connected to the pool-cleaning robot 100 by a cable, the cable may be plugged into a waterproof electrical port of the pool-cleaning robot 100, and the human-computer interaction interface provided on the control box is a physical control panel.

Figure 9:
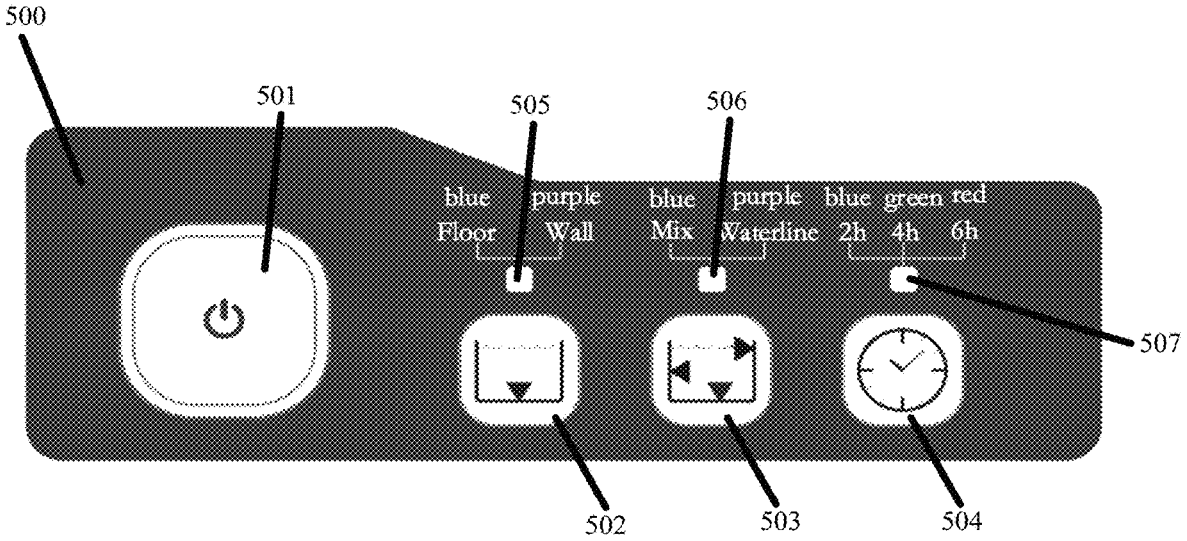
FIG. 9 shows a schematic structural diagram of a physical control panel in an embodiment of the present disclosure.

FIG. 9 shows a schematic structural diagram of a physical control panel in an embodiment of the present disclosure. For the sake of simplicity, in FIG. 9 "floor" represents the floor mode, "wall" represents the wall mode, "mix" represents the mix mode, "waterline" represents the waterline mode.

The physical control panel 500 shown in FIG. 9 contains a plurality of control keys. Exemplarily, the plurality of control keys includes an on/off key 501 ("start/stop"), and operation keys 502, 503 for at least one cleaning mode. A structure in which four cleaning modes share two operation keys 502, 503 is shown in FIG. 9. Different cleaning modes can respond to different operations of a user; for example, operation keys 502, 503 can generate different commands based on different operation durations (e.g., long press, short press), and number of operations by the user (e.g., press once, or press twice), to select from the cleaning modes. For example, the first operation key 502 may be configured to switch between the floor mode and the wall mode, and the second operation key 503 may be configured to switch between the mix mode and the waterline mode. Optionally, the physical control panel 500 may also include a working-duration key 504 for setting a working duration of the pool-cleaning robot.

Optionally, the physical control panel 500 may further comprise a plurality of indicators (LED lights, for example), such as a floor-mode/wall-mode indicator 505, a mix-mode/waterline-mode indicator 506, and a working duration indicator 507, for indicating states of the pool-cleaning robot 100, respectively. The plurality of indicators includes at least one indicator corresponding to at least one of the cleaning modes, each indicator may have one or more light-emitting states (e.g., different colors, patterns of strobing, etc.), which individually or in combination indicate operating states or fault states of the pool-cleaning robot.

By way of example, the following table shows corresponding functions of different control keys and different light-emitting states of respective indicators.

| Control Key or Indicator | Light Color | Lighting Status | Operating State Indicated |
|---|---|---|---|
| "Start/Stop" | Blue | Always on | the pool-cleaning robot is working normally |
| "Start/Stop" | Blue | Strobing | the pool-cleaning robot is on standby |
| "Floor-mode/wall-mode" | Blue/Purple/Red | Always on | Blue means the pool-cleaning robot is working normally in the floor mode/Blue means the pool-cleaning robot is working normally in the wall mode/Red indicates malfunction |
| "Mix-mode/waterline-mode" | Blue/Purple/Red | Always on | Blue means the pool-cleaning robot is working normally in the mix mode/Blue means the pool-cleaning robot is working normally in the waterline mode/Red indicates malfunction |
| "Working duration" | Blue/Green/Red | Always on | Blue means the pool-cleaning robot is set to be working for 2 hours/green means the pool-cleaning robot is set to be working for 5 hours/red means malfunction |
| indicator combination alarm | Red | Always on | 1. When there is a no-load error, the "floor-mode/wall-mode" indicator is red and other indicators are off<br>2. When there is an overload error, the "floor-mode/wall-mode" indicator, and the "mix-mode/waterline-mode" indicator are red, and other indicators are off<br>3. When there is a communication error, the "floor-mode/wall-mode" indicator, the "mix-mode/waterline-mode" indicator and the "working duration" indicator are red, and other indicators are off |
| Resetting indicated by indicators | Red | Always on | The pool-cleaning robot stops after an alarm, and then the pool-cleaning robot sinks to the floor of the pool; press and hold the start/stop key for 4 seconds, the indicator will turn blue, after which the pool-cleaning robot can be restarted |

Exemplarily, the indicators can also be integrated with or separated from the control keys according to different scenarios; for example, the on/off key 501 is integrated with a corresponding indicator, and the indicator for each cleaning mode is separated from its corresponding control key. The housing of each control key with an integrated indicator can be made of light-transmitting material, such as acrylic or glass, etc. By integrating the control keys and indicators, the indicators, individually or in combination, can indicate different states of the pool-cleaning robot, achieving a high degree of reuse, effectively simplifying the panel structure, and reducing costs.

In some further embodiments, the external control device can be a mobile terminal, such as a smart phone, tablet computer, etc., which can display a human-computer interaction interface through a display screen, and the human-computer interaction interface can display virtual indicators and control keys to control the pool-cleaning robot, and more details of their specific control functions or indicated information can be found in descriptions of the physical panel above. The layout of the human-computer interaction interface displayed on the mobile terminal may be different from the layout of the physical panel in FIG. 9.

Figure 10:
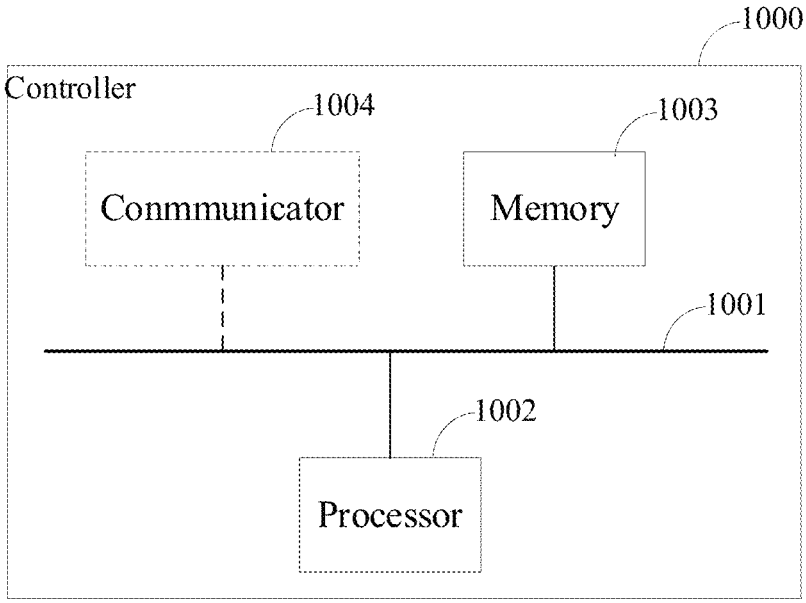
FIG. 10 shows a schematic diagram of a circuit structure of a controller in an embodiment of the present disclosure.

FIG. 10 shows a schematic diagram of a circuit structure of a controller in an embodiment of the present disclosure.

The controller 1000 includes a bus 1001, a processor 1002, and a memory 1003. The processor 1002 and the memory 1003 can communicate with each other through the bus 1001. The memory 1003 may have instructions (e.g., software modules or applications) stored in it. The processor 1002 implements a control module or control terminal in any of the previous embodiments by executing the instructions in the memory 1003.

The bus 1001 may be, for example, a Peripheral Component Interconnect (PCI) bus or an Extended Industry Standard Architecture (EISA) bus. The bus can be divided into address bus, data bus, control bus, etc. For ease of representation, the bus is represented by a single line segment, but this does not indicate that there is only one bus or one type of bus.

In some embodiments, the processor 1002 may be a Central Processing Unit (CPU), a Microprocessor Architecture (MCU), a System on Chip (SoC), or a Field Programmable Logic Array (FPGA), and other implementations. The memory 1003 may include a volatile memory configured for temporary storage of data while running a program, such as a Random Access Memory (RAM).

The memory 1003 may also include a non-volatile memory configured for data storage, such as a Read-Only Memory (ROM), a flash memory, a Hard Disk Drive (HDD), or a Solid-State Disk (SSD).

The controller 1000 may also include a communicator 1004. The communicator 1004 is configured to communicate with an external device. In specific examples, the communicator 1004 may include one or more of wired and/or wireless communication circuit modules. By way of example, the communicator 1004 may include, for example, one or more of a wired network card, a USB module, a serial interface module, etc. When the communicator is a wireless communication module, it may follow wireless communication protocols including, for example, Nearfield communication (NFC) technology, Infrared (IR) technology, Global System for Mobile communications (GSM), General Packet Radio Service (GPRS), Code Division Multiple Access (CDMA), Wideband Code division multiple access (WCDMA), Time-division Code Division Multiple Access (TD-SCDMA), Long Term Evolution (LTE), Bluetooth (BT), Global Navigation Satellite System (GNSS), etc.

The present disclosure also provides a non-transitory computer readable storage medium, storing program instructions, wherein the program instructions are run to implement the functions of the controller in the pool-cleaning robot of the above embodiments, such as control of the motors in the moving mechanism, and the fluid driver.

That is, operations in the above embodiment are implemented as software or computer code that is stored in a storage medium (such as CD ROM, RAM, floppy disk, hard disk or magnetic disc) or implemented as software or computer code that is originally stored in a remote non-transitory storage medium and then downloaded to a local storage medium through Internet, such that the operations represented herein can be executed by a general purpose computer, a dedicated processor, or a programmable or dedicated hardware (such as an ASIC or FPGA) calling the software or computer code.

In summary, the present disclosure provides a pool-cleaning robot, comprising: a robot body with a moving mechanism controlled to move the robot body forward or backward; wherein the robot body has a weight difference between its left and right sides; the moving mechanism includes a driver to drive the moving mechanism unilaterally; the robot body is provided with a fluid inlet-outlet, at least one first fluid inlet, and at least one first fluid outlet, which are communicated with each other. The fluid inlet-outlet is provided with a fluid driver that can be controlled to apply an suction force to at least the first fluid inlet or a discharge force to at least the first fluid outlet; a controller, located in the robot body, wherein the controller is connected to and controls the operation of the moving mechanism and the fluid driver; wherein, when the robot body is on a floor or walls of a pool, combinations of discharge forces, suction forces and weight differences vary to steer the robot. The present disclosure realizes a low-cost, structurally simple pool-cleaning robot that is capable of steering on any surface of a pool.

The above-mentioned embodiments only exemplarily illustrate the principles and effects of the present disclosure, but are not used to limit the present disclosure. Any person skilled in the art may modify or change the above embodiments without violating the spirit and scope of the present disclosure. Therefore, all equivalent modifications or changes made by those skilled in the art without departing from the spirit and technical concepts disclosed by the present disclosure should still be covered by the attached claims of the present disclosure.

What is claimed is:

1. A pool-cleaning robot, comprising:

a robot body, provided with a moving mechanism configured to controllably move the robot body forward or backward; wherein there is a weight difference between left and right sides of the robot body; wherein the moving mechanism comprises a driver, which is connected to a heavier side of the left and right sides of the robot body, and drives the moving mechanism;

wherein the robot body is provided with a fluid inlet-outlet and at least one first fluid inlet communicated with the fluid inlet-outlet through a first fluid channel, and at least one first fluid outlet communicated with the fluid inlet-outlet through a second fluid channel; the first fluid channel and the second fluid channel are communicated; wherein the at least one first fluid inlet and the at least one first fluid outlet are located at a bottom of the robot body; wherein the first fluid channel is provided with at least one filter chamber communicated with the at least one first fluid inlet; wherein the fluid inlet-outlet is provided with a fluid driver configured to controllably apply a suction force to the at least one first fluid inlet or a discharge force to the at least one first fluid outlet; and a controller, provided in the robot body, connected to and controlling the operation of the moving mechanism and the fluid driver; wherein, when the robot body operates on a floor of a pool, a combination of the discharge force and the weight difference steers the pool-cleaning robot; when the robot body operates on a wall of the pool, a combination of the suction force and the weight difference steers the robot body.

2. The pool-cleaning robot according to claim 1, wherein at least one counterweight is removably provided in at least one of the left and right sides of the robot body.

3. The pool-cleaning robot according to claim 1, wherein the heavier side of the left and right sides of the robot body has an uneven mass distribution along a front-to-back direction of the robot body.

4. The pool-cleaning robot according to claim 1, wherein the robot body comprises a battery supplying power to the pool-cleaning robot, and a charging port for connecting the battery.

5. The pool-cleaning robot according to claim 1, wherein the controller is configured to select one of cleaning modes based on an input command and then to control the pool-cleaning robot to work on the floor or the walls of the pool in accordance with the cleaning modes.

6. The pool-cleaning robot according to claim 5, wherein the cleaning modes comprise one or more of:

a floor mode, in which the pool-cleaning robot operates only on the floor of the pool;

a wall mode, in which the pool-cleaning robot reaches a wall of the pool, and operates thereon for a predetermined duration;

a mix mode, in which the pool-cleaning robot operates on both the floor and the walls of the pool; and a waterline mode, in which the pool-cleaning robot reaches a waterline of the pool and operates along the waterline for a predetermined duration.

7. The pool-cleaning robot according to claim 5, wherein the robot body further comprises a gyroscope;

wherein the controller is electrically connected to the gyroscope and configured to identify whether the robot body is located on the floor or a wall of the pool based on output signals of the gyroscope, and limits the moving mechanism within a movement range according to the selected cleaning mode.

8. The pool-cleaning robot according to claim 5, wherein the robot body further comprises a communication interface connected to the controller; wherein the communication interface is in a wired or wireless communication with an external control device; wherein the external control device displays a human-computer interaction interface for receiving operations to form the input command to the controller.

9. The pool-cleaning robot according to claim 8, wherein the human-computer interaction interface is a physical panel or a graphical user interface (GUI); wherein the human-computer interaction interface displays a plurality of control keys for controlling the pool-cleaning robot, and the plurality of control keys comprises operation keys for at least one of the cleaning modes.

10. The pool-cleaning robot according to claim 9, wherein the human-computer interaction interface comprises a plurality of indicators for respectively indicating states of the pool-cleaning robot; wherein the plurality of indicators comprises at least one indicator corresponding to at least one of the cleaning modes; wherein when one of the plurality of indicators and one of the plurality of control keys correspond to the same clean mode, they are integrated together or separated disposed on the human-computer interaction interface; wherein each of the plurality of indicators has one or more light-emitting states, which individually or in combination indicate operating states or fault states of the pool-cleaning robot.

11. The pool-cleaning robot according to claim 1, wherein the at least one first fluid inlet is so configured that when the pool-cleaning robot moves vertically upward along a wall of the pool to the waterline, the at least one first fluid inlet exposes the pool-cleaning robot to air to draw in air to create buoyancy; wherein the buoyancy temporarily suspends the pool-cleaning robot, after which the pool-cleaning robot reorientates due to the weight difference, and then moves in a lateral direction.

12. The pool-cleaning robot according to claim 11, wherein the weight difference is so configured that it causes the pool-cleaning robot to temporarily maintain a steering angle of less than 90 degrees when moving along the waterline.

13. The pool-cleaning robot according to claim 11, wherein the pool-cleaning robot is a wired robot with a cable attached during operation; wherein the weight difference has a steering torque on the pool-cleaning robot greater than a steering torque provided by the cable on the pool-cleaning robot.

14. The pool-cleaning robot according to claim 11, wherein the pool-cleaning robot, when moving laterally, is configured to climb from a current wall where it is located to a target wall, utilizing a frictional force generated when the moving mechanism is in contact with the target wall, the suction force, and a driving force, and to continue moving laterally on the target wall.

15. The pool-cleaning robot according to claim 1, wherein the moving mechanism comprises:

driving wheels, which are connected to the driver and rotate when driven by the driver; and a pair of cleaning rollers respectively disposed at a front portion and a rear portion of the pool-cleaning robot, wherein at least one of the pair of cleaning rollers is connected to the driving wheels in a drivable manner.

* * * * *